US005078428A

United States Patent [19]

Maeno

[11] Patent Number: 5,078,428

[45] Date of Patent: Jan. 7, 1992

[54] COPY-PROOF SHEET

[75] Inventor: Tatsuo Maeno, Tokyo, Japan

[73] Assignee: Hosokawa Printing Co., Ltd., Tokyo, Japan

[21] Appl. No.: 621,258

[22] Filed: Dec. 3, 1990

[51] Int. Cl.[5] ..... B42D 15/00

[52] U.S. Cl. ..... 283/93; 283/902

[58] Field of Search ..... 283/93, 902, 72, 85; 355/201

[56] References Cited

U.S. PATENT DOCUMENTS

| | | | |
|---|---|---|---|
| 4,227,719 | 10/1980 | McElligott et al. | 283/92 |
| 4,420,175 | 12/1983 | Mowry, Jr. | 283/902 |
| 4,582,346 | 4/1986 | Caprio et al. | 283/902 |
| 4,944,533 | 7/1990 | Tsuchiya | 283/93 |

FOREIGN PATENT DOCUMENTS

| | | | |
|---|---|---|---|
| 61-10482 | 1/1986 | Japan | 283/902 |

*Primary Examiner*—P. W. Echols
*Assistant Examiner*—David P. Bryant
*Attorney, Agent, or Firm*—Wenderoth, Lind & Ponack

[57] ABSTRACT

A copy-proof sheet having a longitudinal axis, and being constituted by a background and at least one latent mark, at least one of the background and the latent mark being formed of multi-line images of about 65-line 10% which are reproducible on a copy obtained from the sheet, the other of the background and the latent mark being formed of fine mesh images of about 150-line 10% which are not reproducible on a copy obtained from the sheet; the background and latent mark being distinguishable on the obtained copy due to a difference in color tone; the multi-line images being made up of longitudinal line-containing and lateral line-containing square areas each having sides of about 3 mm long; each longitudinal line-containing square area being made up of lines oriented parallel to the longitudinal axis of the sheet, and each lateral line-containing square area being made up of lines oriented normal to the longitudinal axis; and the longitudinal line-containing and lateral line-containing squares being juxtaposed alternately with an inclination 45° to the longitudinal axis.

3 Claims, 3 Drawing Sheets

COPY-PROOF SHEET

BACKGROUND OF THE INVENTION

The present invention relates to a sheet which is proof against forgery by copying on a copying machine, hereinafter simply a copy-proof sheet, and more particularly relates to improvement in reproductivity of invisible latent marks incorporated in a copy-proof sheet on an obtained copy.

A copy-proof sheet is already known in the art in which one of a background and one or more latent marks such as "VOID" is formed of multi-line images and the other is formed of fine mesh images so that, when processed through a copying machine, only the multi-line images are reproduced on an obtained copy for providing visual recognition of the presence of the latent mark via difference in color tone.

In the case of the copy-proof technique, it is a basic requirement that a latent mark should never be seen on an original document but should appear distinctly from other sections on an obtained copy of the document in order to clearly indicate that the copy is actually a copy and not an original.

When the direction of lines in the multi-line images coincides with, i.e. is parallel to, the scanning direction of a copying machine, the multi-line images are clearly reproduced on an obtained copy. On the other hand, no good reproduction can be expected when the direction of the lines does not coincide with the scanning direction. When a copy-proof sheet is placed on a stack station of a copying machine, the direction of lines in its multi-line images does not always coincide with the scanning direction of the machine. In the use of such a sheet, the multi-line images are sometimes not clearly reproduced in deep color on an obtained copy due to such inconsistency in direction and, as a consequence, are not well distinguished from the fine mesh images. In other words, a latent mark and a background cannot easily be visually distinguished on an obtained copy.

In an attempt to avoid this inconvenience, it has already been proposed to orient lines in the multi-line images with an inclination of 45° with respect to the longitudinal axis of a copy-proof sheet so that the multi-line images should be clearly reproduced on an obtained copy regardless of the position of the sheet placed on the stack station of a copying machine. In this case, however, the multi-line images may not be reproduced on the obtained copy as in the case of fine mesh images depending on the type of copying machine and/or the manner of color tone adjustment. Conversely, the multi-line images and the fine mesh images are both reproduced on the obtained copy when copied at a high production color tone.

It has also been proposed in the prior art to use a copy-proof sheet which includes latent marks formed of multi-line images of longitudinal lines only and latent marks formed of multi-line images of lateral lines only. Then, regardless of the position of the sheet placed on the stack station of a copying machine, one of the two groups of multi-line images coincides with the scanning direction of the machine and, as a consequence, at least the latent mark formed of that group of multi-line images will be distinctly reproduced on the obtained copy. This dual latent mark system is disclosed, for example, in U.S. Pat. No. 4,944,533 issued on July 31, 1990.

Due to indispensable inclusion of latent marks of two different groups, this system is quite unsuited for documents of relatively small size such as personal checks or traveler's checks. In addition, multi-line images of one group are not reproduced on the copy obtained. Even in the case of the multi-line images of the reproducible group, the latent marks reproduced may be camouflaged by other characters and/or patterns printed on an obtained copy depending on their locations.

SUMMARY OF THE INVENTION

It is the basic object of the present invention to provide a copy-proof sheet which assures reliable, distinct reproduction of latent marks from an original document regardless of the position of the sheet placed on the stack station of a copying machine.

In accordance with the present invention, a copy-proof sheet comprises a background and at least one latent mark, one of the background and latent mark is formed of multi-line images of about 65-line 10% which are reproducible on an obtained copy, the other of the background and latent mark is formed of fine mesh images of about 150-line 10% which are not reproducible on the obtained copy, the background and latent marks are distinguishable on the obtained copy via difference in color tone, the multi-line images are made up of longitudinal line and lateral line square areas having sides of about 3 mm, each square area being oriented with the sides at an inclination of 45° with respect to the longitudinal axis of the sheet, and the longitudinal and lateral line square areas being arranged alternately in the direction of the inclination.

DESCRIPTION OF THE PREFERRED EMBODIMENTS

Figure 1:
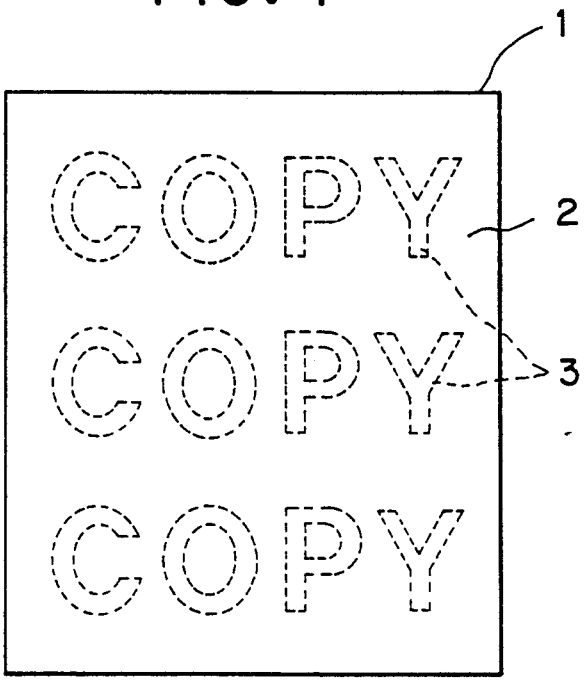
FIG. 1 is a top plan view of one embodiment of the copy-proof sheet in accordance with the present invention.

In FIG. 1, a copy-proof sheet 1 includes a background 2 formed of multi-line images and latent marks 3 "COPY" formed of fine mesh images. The multi-line images are 65-line 10% and reproducible in a deep color on an obtained copy. The fine mesh images are 150-line 10% and not reproducible in an ordinary color tone on the obtained copy. The latent marks 3 may be in the form of another pattern or character such as "VOID". The sheet 1 may contain only one latent mark 3.

Figure 2:
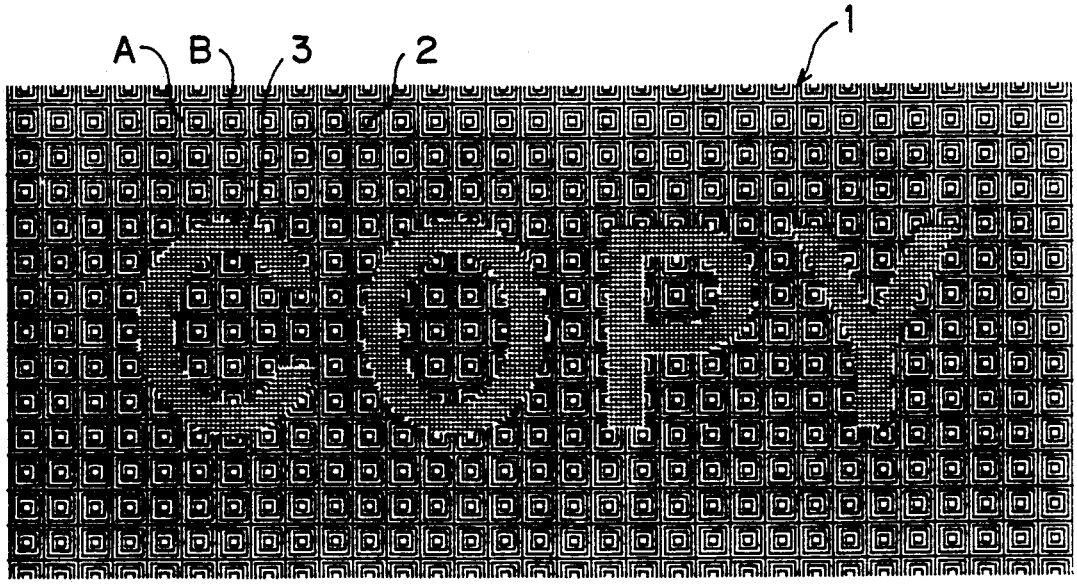
FIG. 2 is an enlarged partial view of the sheet shown in FIG. 1.
Figure 3:
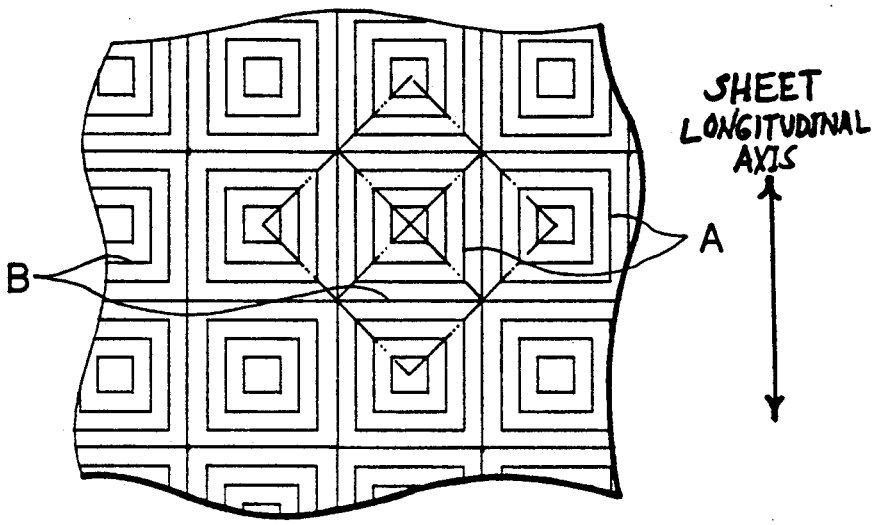
FIG. 3 is an enlarged view of longitudinal and lateral square areas used for the sheet shown in FIG. 2.

As shown in FIGS. 2 and 3, the background 2 is made up of a plurality of longitudinal line-containing square areas A alternating with a plurality of lateral line-containing square areas B. Each of the longitudinal line-containing square areas A is made up of lines oriented parallel to the longitudinal axis of the sheet, and each of the lateral line-containing square areas B is made up of lines oriented normal to the longitudinal axis. The longitudinal and lateral line-containing square areas have sides of about 3 mm and each of the square areas is oriented with the sides at an inclination of 45° with respect to the longitudinal axis of the sheet 1. Further, the longitudinal and lateral line-containing square areas A and B are arranged alternately in the direction of the inclination.

Figure 4:
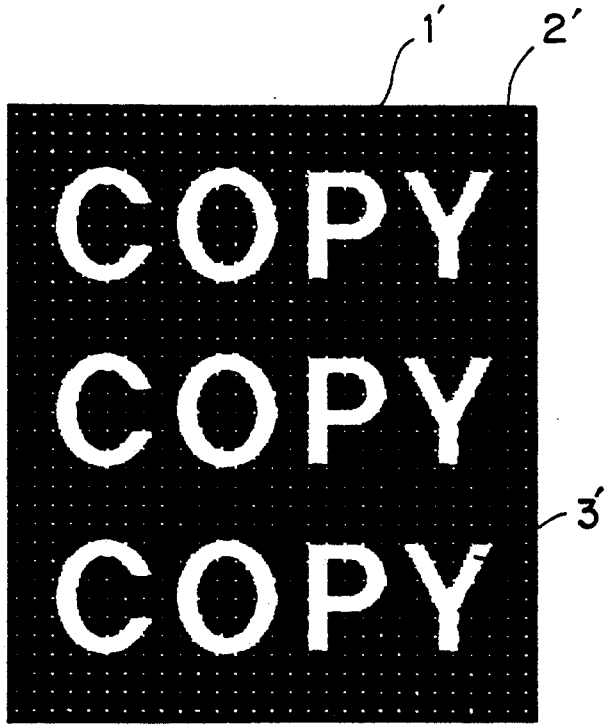
FIG. 4 is a plan view of a copy obtained from the sheet shown in FIG. 1.

A copy 1' obtained from the sheet 1 in FIG. 1 is shown in FIG. 4. The copy 1' includes a background 2' of a deep color tone and latent marks 3' of a light color tone which are visually distinguishable from each other with clear contrast. The multi-line images are reproduced with an ordinary color tone and the fine mesh images are not reproduced with the ordinary color tone to produce a clear distinction in color tone. Reproduction of the multi-line images is influenced by the scanning direction of a copying machine. The multi-line images of the first group, i.e. the group having the lines coinciding with the scanning direction, are reproduced with a color tone deeper than that of the multi-line images of the second group, i.e. the group having lines not coinciding with the scanning direction.

Since the background 3 is formed of a combination of the multi-line images of the two different groups, at least the multi-line images of the one group are reproduced with a deep color tone and the multi-line images of the other group are reproduced with a relatively deep color tone due to the optical interference with the multi-line images of the one group, thereby providing distinctly visible latent marks 3' on the obtained copy 1'.

With recently developed high quality copying machines, not only fine mesh images but also multi-line images in a conventional copy-proof sheet are reproduced poorly when color adjustment of the copying machine is set to a low, i.e. light, position. Both the fine mesh images and the multi-line images are reproduced decently when the color adjustment is set to a high, i.e. deep, level. In the case of the copy-proof sheet in accordance with the present invention, the multi-line images are reproduced decently even at low level color adjustment and more deeply at high level color adjustment on the machine. As a consequence, a clear distinction is obtained between the fine mesh images and the multi-line images.

Due to the small surface area of the square areas and the closely juxtaposed arrangement of the longitudinal and lateral line square areas, there is interference between the multi-line images of the two different groups. A larger size of the square areas would lower the degree of such interference whereas a smaller size of the square areas would impair reproduction of the multi-line images.

Figure 5:
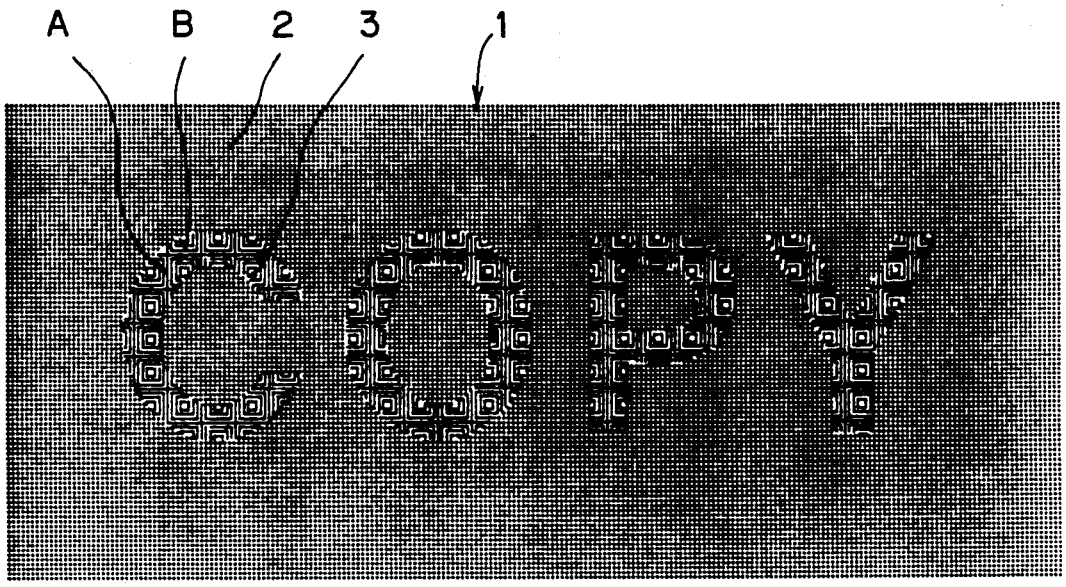
FIG. 5 is an enlarged partial plan view of another embodiment of the copy-proof sheet in accordance with the present invention.
Figure 6:
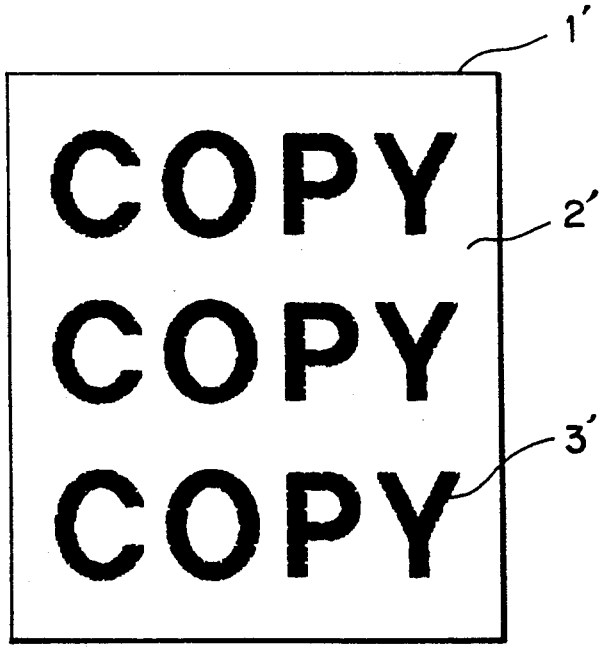
FIG. 6 is a plan view of a copy obtained from the sheet shown in FIG. 5.

Another embodiment of the copy-proof sheet is shown in FIG. 5, in which the background 2 is formed of fine mesh images and the latent marks 3 are formed of multi-line images. A copy 1' obtained from such a sheet 1 is shown in FIG. 6, in which no reproduction occurs in the region of a background 2' and latent marks 3' of a deep color tone are reproduced in the image areas.

In a further embodiment of the present invention, one or more camouflage patterns may be inserted between the fine mesh images and the multi-line images. The presence of such a camouflage pattern in an original document makes it more difficult to detect presence of the latent mark. Further, the latent mark may be covered with an additional pattern which is expected to disappear after copying.

When processed through a copying machine, the multi-line images of the group with the lines coinciding with the scanning direction of the machine, i.e. the first group, are reproduced in a deep color tone whereas the multi-line images of the group with lines not coinciding with the scanning direction, i.e. the second group, are reproduced in a light color tone on the obtained copy. However, thanks to optical interference between the multi-line images of the two groups, the multi-line images of the second group are reproduced in a color tone deeper than conventional. No reproduction of the fine mesh images allows reliable reproduction of the latent marks with clear distinction. As a consequence, no difference in the mode of reproduction of the latent marks is caused by the position of the original document on the stack station of the copying machine. Thus, forgery by copying on a photocopying machine can be prevented even when only one latent mark is carried by the original document.

The following merits result from the present invention:

(i) Since the direction of the lines of at least one of the multi-line images of the two different groups coincides with the scanning direction of a copying machine, the multi-line images of the one group are reproduced with a deep color tone. In addition, the multi-line images of another group are reproduced with a color tone deeper than conventional due to interference with the multi-line images of the one group. A combination of the multi-line images of the two groups after reproduction provides clear distinction from the fine mesh images. Latent marks on an original document are visually developed on an obtained copy regardless of the type of copying machine used and the degree of color tone adjustment.

(ii) Alternate arrangement of the lines of the longitudinal and lateral line square areas allows reliable reproduction of lines in the multi-line images of any location on an original document. Since presence of only one latent mark on the original document can effectively prevent copying for fraudulent intent, the invention is applicable to documents of any size such as personal checks and traveler's checks.

(iii) Alternative direction of the lines of the longitudinal and lateral line square areas on an original document dazzles the naked eye, thereby making borders between the multi-line images and the fine mesh images very obscure and, as a consequence, making visual identification of the latent marks on the original document difficult.

(iv) Thanks to the inclined orientation of the square areas, almost the entire region of an original document is uniformly occupied by lines of the multi-line images, thereby assuring fine, beautiful reproduction of images on an obtained copy.

I claim:

1. A copy-proof sheet having a longitudinal axis, comprising:

a background and at least one latent mark, at least one of said background and said latent mark being formed of multi-line images of about 65-line 10% which are reproducible on a copy obtained from said sheet, the other of said background and said latent mark being formed of fine mesh images of about 150-line 10% which are not reproducible on a copy obtained from said sheet;

said background and latent mark being distinguishable on said obtained copy due to a difference in color tone;

said multi-line images being made up of longitudinal line-containing and lateral line-containing square areas each having sides of about 3 mm long;

each said longitudinal line-containing square area being made up of lines oriented parallel to the longitudinal axis of said sheet, and each said lateral line-containing square area being made up of lines oriented normal to said longitudinal axis; and said longitudinal line-containing and lateral line-containing square areas being juxtaposed alternately with the sides thereof inclined at 45° to said longitudinal axis.

2. A copy-proof sheet as claimed in claim 1 in which said background is formed of said multi-line images and said latent mark is formed of said fine mesh images.

3. A copy-proof sheet as claimed in claim 1 in which said background is formed of said fine mesh images and said latent mark is formed of said multi-line images.

* * * * *